US008857675B2

(12) United States Patent
Gysel et al.

(10) Patent No.: US 8,857,675 B2
(45) Date of Patent: Oct. 14, 2014

(54) DEVICE FOR THE METERED FILLING OF BULK MATERIAL

(75) Inventors: Markus Gysel, Diessenhofen (CH); Hansruedi Frueh, Beringen (CH); Tobias Bury, Tengen (CH)

(73) Assignee: Robert Bosch GmbH, Stuttgart (DE)

( * ) Notice: Subject to any disclaimer, the term of this patent is extended or adjusted under 35 U.S.C. 154(b) by 82 days.

(21) Appl. No.: 13/505,472

(22) PCT Filed: Sep. 28, 2010

(86) PCT No.: PCT/EP2010/064361

§ 371 (c)(1), (2), (4) Date: Jul. 23, 2012

(87) PCT Pub. No.: WO2011/051066

PCT Pub. Date: May 5, 2011

(65) Prior Publication Data

US 2012/0279999 A1 Nov. 8, 2012

(30) Foreign Application Priority Data

Nov. 2, 2009 (DE) ..... 10 2009 046 288

(51) Int. Cl.

| | |
|---|---|
| ***B65B 1/30*** | (2006.01) |
| ***B65B 1/12*** | (2006.01) |
| ***B65B 1/42*** | (2006.01) |
| ***B65B 39/00*** | (2006.01) |
| *B65B 9/20* | (2012.01) |

(52) U.S. Cl.

CPC ... *B65B 1/12* (2013.01); *B65B 1/42* (2013.01); *B65B 9/20* (2013.01); *B65B 39/004* (2013.01)

USPC ..... 222/413; 141/10; 141/256; 141/255; 141/258; 141/259

(58) Field of Classification Search

CPC ..... B65B 1/12; B65B 37/10; B65B 1/42; B65B 9/20

USPC ..... 222/413; 141/10, 256, 255, 258, 259, 141/331

See application file for complete search history.

(56) References Cited

U.S. PATENT DOCUMENTS 2,413,916 A * 1/1947 Hallead ..... 141/117
2,640,630 A * 6/1953 Genco ..... 222/509

(Continued)

FOREIGN PATENT DOCUMENTS

CN 100998295 7/2007
CN 201109492 9/2008

(Continued)

OTHER PUBLICATIONS

PCT/EP2010/064361 International Search Report dated Feb. 18, 2011 (Translation and Original, 4 pages).

*Primary Examiner* — Kevin P Shaver
*Assistant Examiner* — Michael J Melaragno
(74) *Attorney, Agent, or Firm* — Michael Best & Friedrich LLP

(57) ABSTRACT

The invention relates to a device (10) for the metered filling of bulk material having a metering screw (16), which is arranged in a hollow cylinder shaped metering tube (12) and which can be slid in a longitudinal axis (L) of the metering tube (12), having a closing head (18) for closing a metering opening (14), wherein the closing head (18) has a substantially conical surface (20) and the metering tube (12) transitions after the metering opening (14) into a hollow cylinder shaped mouthpiece (32) having a larger inner diameter ($D_{Mi}$) compared to the inner diameter ($d_{Ri}$) of the metering tube (12).

8 Claims, 1 Drawing Sheet

(56) References Cited

U.S. PATENT DOCUMENTS

| | | | | | |
|---|---|---|---|---|---|
| 3,486,664 | A * | 12/1969 | Loomans | 222/413 |
| 3,790,040 | A * | 2/1974 | Bahr et al. | 222/413 |
| 4,235,265 | A * | 11/1980 | Feliks | 141/85 |
| 4,322,021 | A * | 3/1982 | Olsson | 222/231 |
| 4,537,335 | A * | 8/1985 | Rangwala et al. | 222/496 |
| 4,582,097 | A * | 4/1986 | Izzi et al. | 141/1 |
| 4,648,421 | A * | 3/1987 | Chant et al. | 137/312 |
| 4,938,391 | A * | 7/1990 | Grundler | 222/278 |
| 5,027,983 | A * | 7/1991 | Wakabayashi et al. | 222/309 |
| 5,080,264 | A * | 1/1992 | Limper | 222/241 |
| 5,137,187 | A * | 8/1992 | Nichols et al. | 222/504 |
| 5,438,396 | A * | 8/1995 | Mawdesley | 399/262 |
| 5,655,690 | A * | 8/1997 | DeGoler et al. | 222/380 |
| 5,685,349 | A * | 11/1997 | Mihail et al. | 141/144 |
| 5,758,698 | A * | 6/1998 | Kaneko | 141/263 |
| 6,056,025 | A * | 5/2000 | Wegman | 141/67 |
| 6,098,677 | A * | 8/2000 | Wegman et al. | 141/256 |
| 6,237,815 | B1 * | 5/2001 | Schlosser | 222/241 |
| 6,810,921 | B2 * | 11/2004 | Schlosser | 141/2 |
| 7,036,538 | B2 * | 5/2006 | Schlosser | 141/260 |
| 7,063,111 | B2 * | 6/2006 | Schlosser | 141/10 |
| 8,104,520 | B2 * | 1/2012 | Ours et al. | 141/10 |
| 8,167,007 | B2 * | 5/2012 | Gustafsson | 141/264 |
| 2002/0003005 | A1 * | 1/2002 | Martin | 141/39 |
| 2007/0080179 | A1 * | 4/2007 | Brinz et al. | 222/412 |
| 2009/0020563 | A1 | 1/2009 | Morimoto et al. | |
| 2012/0298253 | A1 * | 11/2012 | Maas et al. | 141/5 |

FOREIGN PATENT DOCUMENTS

| | | | | |
|---|---|---|---|---|
| CN | 201176269 | | 1/2009 | |
| CN | 101450755 | | 6/2009 | |
| EP | 1582467 | | 10/2005 | |
| EP | 1582467 | A1 * | 10/2005 | B65B 39/00 |
| GB | 1338874 | | 11/1973 | |
| GB | 1427130 | | 3/1976 | |
| GB | 2430665 | | 4/2007 | |
| JP | 55-83956 | | 6/1980 | |
| JP | H08244701 | | 9/1996 | |
| JP | 2005206219 | | 8/2005 | |

* cited by examiner

DEVICE FOR THE METERED FILLING OF BULK MATERIAL

BACKGROUND OF THE INVENTION

The invention relates to a device for the metered filling of bulk material having a metering screw, which is arranged in a hollow cylinder shaped metering tube and which can be slid in a longitudinal axis (L) of the metering tube, having a closing head for closing a metering opening, wherein the closing head has a substantially conical surface.

The European patent publication EP 1 582 467 B1 discloses a metering device for the filling of bulk material, particularly into small bags, so-called stick pack packages. A bag is thereby formed from a film web, into which the tubular metering device projects.

Such devices comprise a vertically running metering tube having a metering screw, which can move in the axial direction and rotate therein. Bulk material which is to be filled in bags or other types of containers is poured from above into the metering tube and is discharged via the metering screw in metered portions into bags at the lower end of said metering tube. In order to interrupt the flow and portioning of the bulk material, the lower end of the metering tube can be closed with a sealing means.

A problem with this metering device is that when said metering device is open, the metered product is directed by the closing cone against the inside of the bag. In so doing, particles of the bulk material remain stuck to the inside wall of the bag. Particularly the quality and the impermeability of the cross-sealing seam, with which the bag is subsequently closed, can be compromised by these particles. In the case of conventional metering devices, it must therefore be ensured that when the part of the bag used to configure the cross-sealing seam passes the metering device, said metering device is already closed so that no contamination occurs. Because the metering time available as a rule limits the machine output or respectively the possible number of cycles, the possible machine output is lowered by this early closing of the metering device.

A metering device would be desirable, with which the bulk material to be metered is directed into the bag in such a way that it cannot stick to the bag's inside wall in the upper region of said bag during filling.

SUMMARY OF THE INVENTION

The aim underlying the invention is to design a device of the kind mentioned at the beginning of the application in such a way that when filling bags, particularly small bags, as so-called stick packs, as little bulk material as possible or no bulk material sticks to the upper region of the bag's inside wall, which serves to configure the cross seam. For this reason, the quality and impermeability of the bag is to be improved. As a result of the absence of contamination of the bag's inside walls, especially the metering device shall be able to remain open until shortly prior to the point in time, in which the bag is closed by means of the cross-sealing station, and therefore as large as a window as possible of a work cycle of the machine is available for the metering and consequently the number of machine cycles can be increased.

The fact that the metering tube transitions after the metering opening into a hollow cylinder shaped mouthpiece having a larger inner diameter compared to the inner diameter of the metering tube leads to the aim of the invention being met.

In order to provide a good seal between metering tube and closing head, the closing head can comprise a cylinder shaped lateral surface, which in a closing position fits snugly in the region of the metering opening of the cylinder shaped inside wall of the metering tube.

In an open position, the mouthpiece preferably extends in the longitudinal axis over the closing head to some extent.

The transition from the cylinder shaped inside wall of the metering tube to the cylinder shaped inside wall of the mouthpiece is preferably designed as a truncated cone-shaped transition surface, wherein the angle of aperture of the truncated cone-shaped transition surface is greater than the angle of aperture of the conical surface of the closing head.

The surface of the annular gap defined by the difference between the inner diameter of the mouthpiece and the inner diameter of the metering tube is advantageously greater than the so-called metering surface of the metering screw in the open position.

The mouthpiece is preferably specified as part of an insert to the metering tube in a manner allowing it to be exchangeable, wherein the metering opening can be part of the insert.

The device according to the invention is suitable for all bulk materials; however particularly for bulk materials having relatively small grain sizes from a few hundredths to several tenths of a millimeter diameter. The device is preferably used for the filling of bulk material in the medical and food sectors, for example for the filling of medicines in powder form, sugar or seasonings. The bulk material is preferably packaged in bags, in particular vertical tubular bags or side sealed bags. Other types of packaging can however also be used.

BRIEF DESCRIPTION OF THE DRAWINGS

Further advantages, features and details of the invention ensue from the following description of preferred exemplary embodiments as well as with the aid of the drawings, which only are provided for explanation and are not to be narrowly interpreted. The drawings show schematically in FIG. 1 a longitudinal section through the metering region of a metering device with raised metering screw in the closed position.

DETAILED DESCRIPTION

Figure 1:
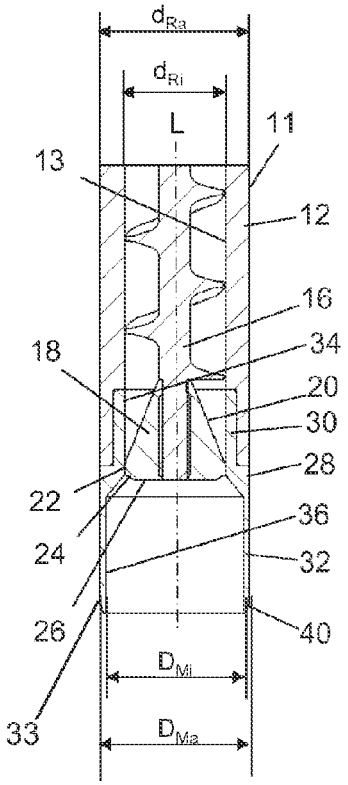
Figure 2:
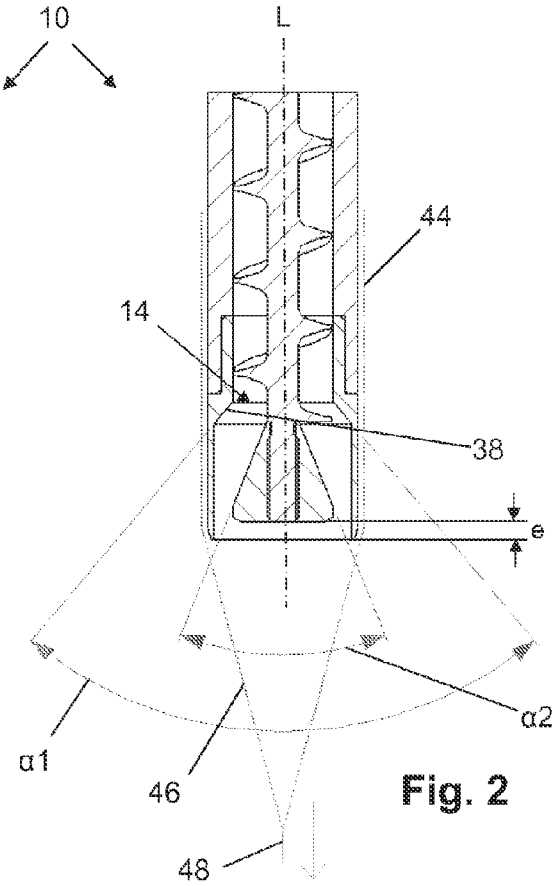
FIG. 2 a longitudinal section through the metering region of the metering device of FIG. 1 with lowered metering screw in the open position.

A metering device 10, which is partially depicted in FIGS. 1 and 2, for the metered filling of bulk material into tubular bags, in particular so-called stick pack packages, comprises a hollow cylinder shaped metering tube 12 having a vertically aligned longitudinal axis L and a metering opening 14 on the lower end of the metering tube. A metering screw 16, which is arranged coaxially with respect to the metering tube 12 and can be slid in the axial direction and rotated about its own longitudinal axis, is located in said metering tube 12. The outer diameter of the metering screw 16 has substantially the same size as the inner diameter $d_{Ri}$ of the metering tube 12.

The metering screw 16 has a closing head 18 on the end thereof near the metering opening 14, said closing head comprising a conical surface which conically widens in the metering direction. A cylinder shaped lateral surface attaches to the conical surface 20. The diameter of the lateral surface 22 of the closing head 18 corresponds substantially to the diameter of the metering screw 16 or respectively to the inner diameter $d_{Ri}$ of the metering tube 12. In the closed position of the metering screw 16, the cylinder shaped lateral surface 22 of the inside wall 13 of the metering tube 12 substantially abuts on the closing head of sad metering screw. The cylinder shaped lateral surface 22 transitions via an end chamfer 24 into a closing head floor 26 that forms the free end of the closing head 18. In the present example, said closing head 18 is screwed to the free end of the metering screw 12.

The metering tube 12 is connected to an insert 28 disposed coaxially with respect to said metering tube 12 in the region of the metering opening 14. An end of the insert 28 is fixed in the metering tube 12 as a hollow cylinder shaped connecting part 30 in such a way that the cylinder shaped inside wall 13 of the connecting part 30 aligns with the cylinder shaped inside wall 13 of said metering tube 12. Said connecting part 30 thereby becomes with the inside wall 13 a part of said metering tube 12 and also comprises in the depicted embodiment the metering opening 14 of said metering tube 12.

The connecting part 30 of the insert 28 transitions into a hollow cylinder shaped mouthpiece 32 in the proximity of the metering opening 14. The insert 28 with the mouthpiece 32 is inserted in the present example into the metering tube 12 via the connecting part 30 and is held therein in a force-fitting manner. The connecting part 30 can also be glued in place by means of an if need be soluble adhesive. The insert 28 can also be screwed to the metering tube 12 or be attached by other means to said metering tube 12. As illustrated in FIG. 1, the mouthpiece (32) has an outer diameter ($D_{Ma}$) substantially equivalent to an outer diameter ($d_{Ra}$) of the metering tube (12).

The inner diameter $D_{Mi}$ of the mouthpiece 32 is larger than the inner diameter $d_{Ri}$ of the metering tube 12 or respectively of the connecting part 30. The transition from the cylinder shaped inside wall 34 of the connecting part 30 to the cylinder shaped inside wall 36 of the mouthpiece 32 is designed as a truncated cone-shaped transition surface 38. The angle of aperture ∀1 of the truncated cone-shaped transition surface 38 is thereby larger than the angle of aperture ∀2 of the conical surface 20 of the closing head 18, and therefore a flared passage channel forms between the conical surface 20 and the transition surface 38 when opening the metering opening 14 in the metering tube 12 or respectively in the connecting part 30. If the angle of aperture ∀1 of the transition surface 38 is equal to or smaller than the angle of aperture ∀2 of the conical surface 20 of the closing head 18, the bulk material to be metered can become blocked.

The inner diameter $D_{Mi}$ of the mouthpiece 32 is selected as large as possible, wherein the maximally admissible inner diameter is defined such that the required stability of shape and wear resistance of said mouthpiece 32 is still ensured at the remaining thickness. The outer wall 33 of the mouthpiece 32 substantially aligns with the outer wall 11 of the metering tube 12. Said mouthpiece 32 is provided with an end chamfer 40 on the free end thereof.

The inner diameter $D_{Mi}$ of the mouthpiece 32, which is larger in comparison to the inner diameter $d_{Ri}$ of the metering tube 12 leads during a projection in the longitudinal axis L of the metering tube 12 onto a plane perpendicular to the longitudinal axis L to an annular gap 42 between the inside wall 13 of the metering tube 12 and the inside wall 36 of the mouthpiece 32.

Figure 3:
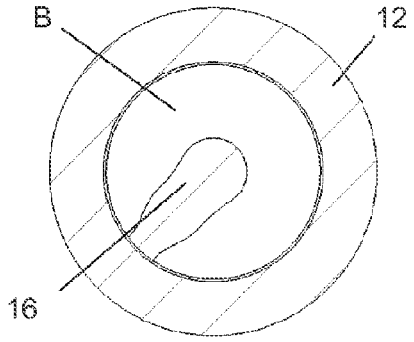
FIG. 3 the metering surface of the metering screw of the metering device of FIG. 1.
Figure 4:
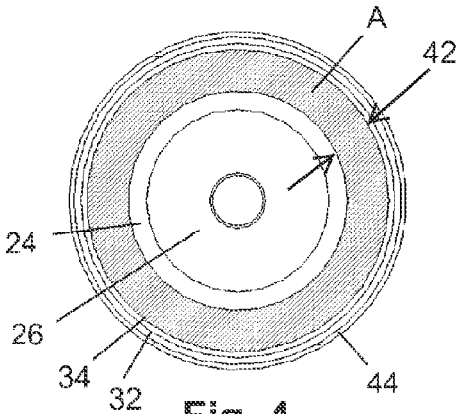
FIG. 4 a top view of the lower end of the metering region of the metering device of FIG. 2 in the viewing direction y.

The annular gap surface A (FIG. 4) formed from the annular gap 42 and defining a passage cross section for the bulk material is at least as large as or larger than the metering surface B (FIG. 3) determined by the metering screw diameter, the screw pitch, winding thickness and screw core, said metering surface B referring to the surface, through which the bulk material escapes when the metering screw 16 is in the open position. If the annular gap surface A is smaller than the metering surface B, the bulk material to be metered can also in this instance become blocked.

When filling a bag 46 consisting of a film tube 44 formed by turning a film web around the metering tube 12, the film tube 44, which was formed from the film web and fits tightly to the outer wall 11, 33 of the metering tube 12 or respectively the mouthpiece 32, is withdrawn in the direction of the longitudinal axis L of the metering tube 12—as indicated in FIG. 2 with an arrow. After each filling process, the filled bag 46 is closed with a sealing seam applied transversely to the direction of withdrawal.

The length of the mouthpiece 32 is calculated such that in the open position of the metering screw 16, i.e. when said metering screw 16 is turned out, the excess length e of the free end of the mouthpiece 32 just extends to the closing head floor 26, so that the bulk material is directed against the inside wall of the mouthpiece 32 and not against the inside of the film tube 44.

The invention claimed is:

1. A device for the metered filling of bulk material having a metering screw (16), which is arranged in a hollow cylinder shaped metering tube (12) and which can be slid along a longitudinal axis (L) of the metering tube (12), the metering screw having a closing head (18) for closing a metering opening (14), wherein the closing head (18) has a substantially conical surface (20), characterized in that said metering tube (12) transitions after the metering opening (14) into a hollow cylinder shaped mouthpiece (32) having a-larger inner diameter ($D_{Mi}$) compared to an inner diameter ($d_{Ri'}$) of said metering tube (12), wherein a diameter of the closing head (18) is substantially the same as the inner diameter ($d_{Ri'}$) of the metering tube (12), wherein a surface (A) of an annular ring (42) defined by a difference between the inner diameter ($D_{Mi'}$) of the mouthpiece (32) and the inner diameter ($d_{Ri}$) of the metering tube (12) is greater than a metering surface (B) of the metering screw (16) in an open position, and wherein the mouthpiece (32) extends along the longitudinal axis (L) over the closing head (18) to an extent (e) in the open position.

2. The device according to claim 1, characterized in that a transition from a cylinder shaped inside wall (13) of the metering tube (12) to a cylinder shaped inside wall (36) of the mouthpiece (32) is a truncated cone-shaped transition surface (38), wherein an angle of aperture (α1) of the truncated cone-shaped transition surface (38) is greater than an angle of aperture (α2) of the conical surface (20) of the closing head (18).

3. The device according to claim 1, characterized in that the mouthpiece (32) is part of an insert (28) to the metering tube (12) in a manner allowing the mouthpiece to be exchanged.

4. The device according to claim 3, characterized in that the metering opening (14) is a part of the insert (28).

5. A device for the metered filling of bulk material having a metering screw (16), which is arranged in a hollow cylinder shaped metering tube (12) and which can be slid along a longitudinal axis (L) of the metering tube (12), the metering screw having a closing head (18) for closing a metering opening (14), wherein the closing head (18) has a substantially conical surface (20), characterized in that said metering tube (12) transitions after the metering opening (14) into a mouthpiece (32), characterized in that a transition from a cylinder shaped inside wall (13) of the metering tube (12) to a cylinder shaped inside wall (36) of the mouthpiece (32) is a truncated cone-shaped transition surface (38), wherein a diameter of the closing head 18 is substantially the same as an inner diameter $d_{Ri}$ of the metering tube 12, wherein a surface A of an annular ring 42 defined b a difference between an inner diameter $D_{Mi}$ of the mouth piece 32 and the inner diameter $d_{Ri}$ of the metering tube 12 is greater than a metering surface (B) of the metering screw (16) in an open position, and wherein the mouthpiece (32) extends along the longitudinal axis (L) over the closing head (18) to an extent (e) in the open position.

6. The device according to claim 5, characterized in that the mouthpiece (32) is part of an insert (28) to the metering tube (12) in a manner allowing the mouthpiece (32) to be exchanged.

7. The device according to claim 6, characterized in that the metering opening (14) is a part of the insert (28).

8. The device according to claim 5, wherein an angle of aperture ($\alpha$1) of the truncated cone-shaped transition surface (38) is greater than an angle of aperture ($\alpha$2) of the conical surface (20) of the closing head (18).

* * * * *